US005685373A

United States Patent [19]

Collins et al.

[11] Patent Number: 5,685,373

[45] Date of Patent: Nov. 11, 1997

[54] ASSEMBLY AND PROCESS FOR DRILLING AND COMPLETING MULTIPLE WELLS

[75] Inventors: Gary J. Collins, Richmond; Kevin O. Trahan; John Lindley Baugh, both of Houston, all of Tex.

[73] Assignee: Marathon Oil Company, Findlay, Ohio

[21] Appl. No.: 548,565

[22] Filed: Oct. 26, 1995

Related U.S. Application Data

[63] Continuation-in-part of Ser. No. 508,635, Jul. 26, 1995.

[51] Int. Cl.[6] ..... E21B 15/04

[52] U.S. Cl. ..... 166/313; 166/341; 166/366; 175/5

[58] Field of Search ..... 166/313, 366, 166/117.5, 341, 345, 349; 175/61, 5–7, 79

[56] References Cited

U.S. PATENT DOCUMENTS

| | | | |
|---|---|---|---|
| 2,211,803 | 8/1940 | Warburton . | |
| 4,068,729 | 1/1978 | Peevey | 175/8 |
| 4,396,075 | 8/1983 | Wood et al. | 175/79 |
| 4,415,205 | 11/1983 | Rehm et al. | 299/5 |
| 4,573,541 | 3/1986 | Josse et al. | 175/78 |
| 4,754,817 | 7/1988 | Goldsmith | 175/7 |
| 4,807,704 | 2/1989 | Hsu et al. | 166/313 |
| 5,297,638 | 3/1994 | Dolence | 175/61 |
| 5,311,936 | 5/1994 | McNair | 166/50 |
| 5,325,924 | 7/1994 | Bangert et al. | 166/313 |
| 5,330,007 | 7/1994 | Collins et al. | 166/313 |
| 5,560,435 | 10/1996 | Sharp | 175/5 |

OTHER PUBLICATIONS

N.S. Avocato, J.R. Jackson, I.G. Jones, and S.J. Murphy, "Optimising Slot Usage on a Minimum Facilities Platform," *SPE 30346*, presented at the Offshore Europe Conference, Aberdeen, Scotland, (Sep. 5–8, 1995), pp. 27–32.

Kislitsyn et al., "Drilling technology and equipment for multiple—borehole," 1994, 622.243 p.

*Primary Examiner*—Dennis L. Taylor

*Attorney, Agent, or Firm*—Jack L. Hummel; Jack E. Ebel

[57] ABSTRACT

An apparatus and process are provided for drilling and completing multiple subterranean wells from a template which is secured within a cased well bore extending to the surface. An orienting cam having a bore therethrough is positioned above the template such that the bore through the orienting cam is automatically aligned with one of at least two bores through the template. Fluid tight seals are provided between the orienting cam and the casing and between the orienting cam and one of the at least two bores through the template. Thereafter, a drill string including a drill bit is lowered from the surface of the earth through the casing, the bore through the orienting cam and the one bore through said template to drill a first subterranean well bore. Drilling fluid and cuttings resulting from drilling a subterranean formation are circulated back to the surface via first subterranean well bore, one of the at least two bores through the template and the bore through the orienting cam and through the casing such that the drilling mud contacts the internal wall of the casing. The orienting cam is repositioned above the template such that the bore through the orienting cam is aligned with another of the at least two bores through the template. Thereafter, a second subterranean well bore is drilled via another of the bores through the template in a manner similar to that described for the first well bore.

20 Claims, 11 Drawing Sheets

ASSEMBLY AND PROCESS FOR DRILLING AND COMPLETING MULTIPLE WELLS

CROSS-REFERENCE TO RELATED APPLICATIONS

This application is a continuation-in-part of copending U.S. patent application, Ser. No. 08/508,635, filed Jul. 26, 1995.

BACKGROUND OF THE INVENTION

1. Field of the Invention

The present invention relates to an assembly and process for drilling multiple subterranean wells from a cased wellbore extending to the surface, and more particularly, to such assembly and process for drilling and completing multiple subterranean wells through a template having at least two bores therethrough and being secured to casing wherein fluid is circulated to the surface during drilling via the casing.

2. Description of Related Art

Increasingly, well bores are being drilled into subterranean formations at an orientation which is purposely deviated from true vertical by means of conventional whipstock technology or a mud motor secured in the drill string adjacent the drill bit. In fractured subterranean formations, deviated wells are utilized to increase the area of drainage defined by the well within the subterranean formation, and thus, increase production of hydrocarbons from the subterranean formation. An inherent problem in utilizing a conventional whipstock to drill a deviated well is that both the depth and radial orientation of the whipstock is set when the whipstock is positioned in the well bore and cannot be changed without retrieving the whipstock from the well bore and changing the depth and/or radial orientation thereof.

In addition, walls drilled from offshore drilling platforms are usually deviated to increase the number of wells which can be drilled and completed from a single platform. Offshore drilling platforms which are utilized in deep water to drill and complete wells in a subterranean formation vary in size, structure, and cost depending upon the water depth and the loads in which the platform will be set. For example, a platform may be constructed to be supported in part by one leg or caisson which extends to the ocean floor or by as many as eight such legs or caissons. Costs of such offshore drilling platforms vary from approximately $5,000,000 U.S. to $500,000,000 U.S. Each offshore drilling platform is equipped with a set number of slots via which deviated wells can be drilled and completed through casings which are secured to the platform by conventional techniques.

Due to the significant capital expenditure required for these offshore platforms, templates and processes for drilling and completing multiple cased wells have been developed. During drilling operations utilizing such templates, a conventional tubular riser is lowered into the surface or intermediate casing and inserted into one of the bores formed through the template. Once the riser is properly positioned within the bore, the surface or intermediate casing is cemented within the well bore by conventional techniques and a conventional drill string including a drill bit and mud motor (not illustrated) is transported within the riser into the bore of the template whereupon the float valve or plug and any cement is drilled out of the template bore. Thereafter,a well bore is drilled by the drill string in a conventional manner with drilling mud and formation cuttings being circulated out of the well bore to the surface via the riser. The drill string is then withdrawn from the riser and, after the well is equipped with any tubulars, the riser is withdrawn from template bore, rotated, and inserted into another bore through the template. An additional well can then be drilled and completed in a manner as just described. However, the manipulation of the riser at the surface to insert the same in and out of a given bore through a multi well template which is positioned within a cased well bore at depths of up to ten thousand feet or more and to rotate the riser for insertion into another bore may be problematic. Thus, a need exists for an assembly and process for drilling and completing multiple cased wells through a multiple well template positioned within a cased well at a subterranean location which eliminates the need to use a downhole riser to connect a subsurface or downhole template to the surface.

Accordingly, it is an object of the present invention to provide an assembly and process for drilling and completing multiple wells within subterranean formation(s) from a cased well bore which eliminates the need to utilize a riser in conjunction therewith.

SUMMARY OF THE INVENTION

To achieve the foregoing and other objects, and in accordance with the purposes of the present invention, as embodied and broadly described herein, one characterization of the present invention is a process for drilling subterranean wells from a casing which extends from a subterranean depth to the surface of the earth and to which a downhole or subsurface template having at least two bores therethrough is secured. The process comprises drilling a first subterranean well bore through one of the bores through the template and into a subterranean formation and circulating fluid to the surface via said casing during the step of drilling.

In another characterization of the present invention, a process for drilling subterranean wells from a casing which extends from a subterranean depth to the surface of the earth and to which a downhole or subsurface template having at least two bores therethrough is secured is provided. The process comprises positioning an orienting cam having a bore therethrough above the template such that the bore through the orienting cam is aligned with one of the at least two bores through the template. A fluid tight seal is provided between the orienting cam and the casing. A fluid tight seal is also provided between the orienting cam and one of the at least two bores through the template.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENTS

Figure 1:
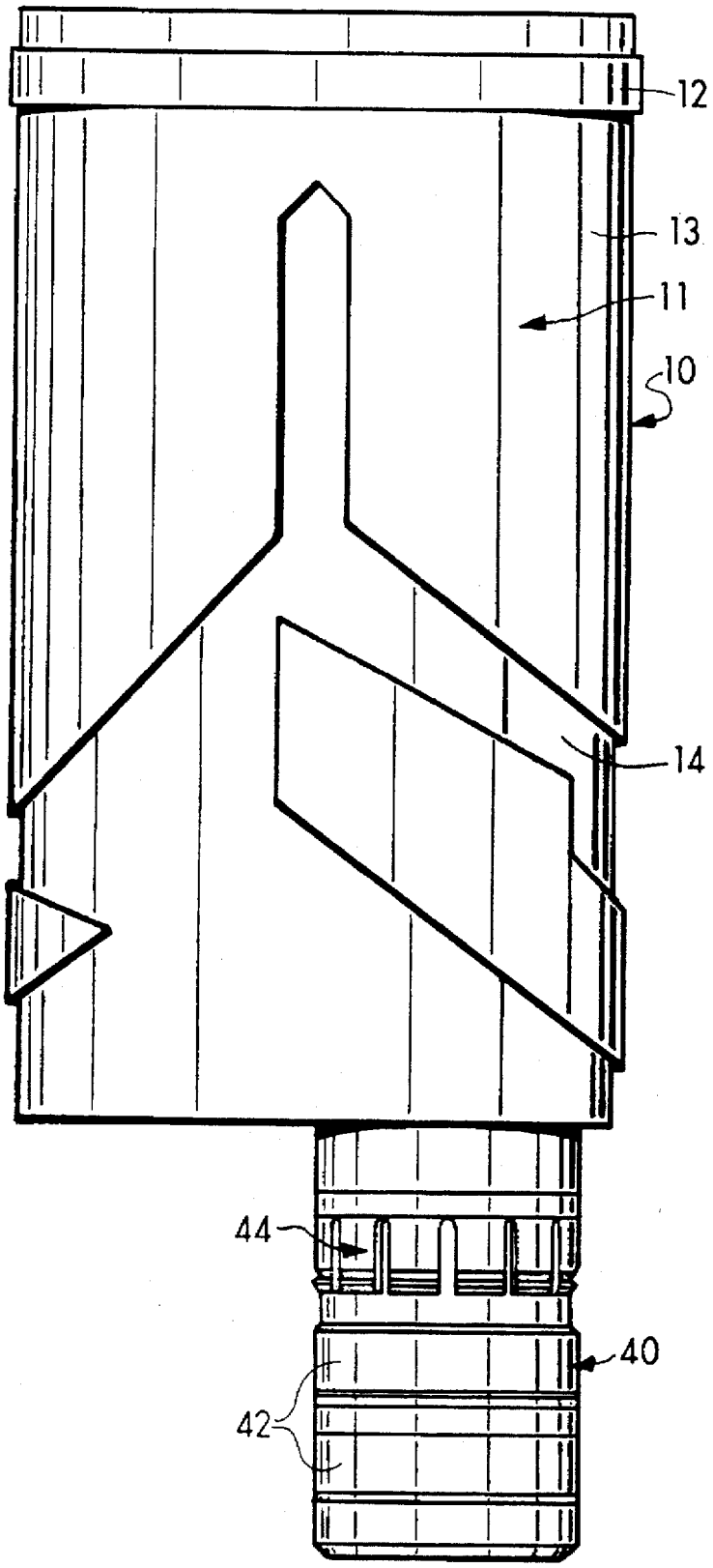
FIG. 1 is a perspective view of one embodiment of the assembly of the present invention which includes a positioning cam and a tubular seal assembly and which is utilized in conjunction with a subsurface or downhole multiple well template.

As illustrated in FIG. 1, the assembly of the present invention which is illustrated generally as 10 facilitates the drilling and completion of multiple wells by means of a downhole or subsurface templates, such as the template described in col. 3, line 49–col. 4, line 31, col. 4, lines 47–col. 7, line 45, and col. 9, line 25–col. 11, line 13 of U.S. Pat. No. 5,330,007 which is incorporated herein by reference. The apparatus 10 comprises a positioning cam 11 and a tubular seal assembly 40 which is secured to and depends from cam 11 in a manner described below. Cam 11 is provided with at least one annular seal 12, for example a moly glass seal ring(s) such as manufactured by Baker Oil Tools, around the outer periphery thereof and a J-4 slot 14 formed in the external surface 13 thereof.

Figure 2:
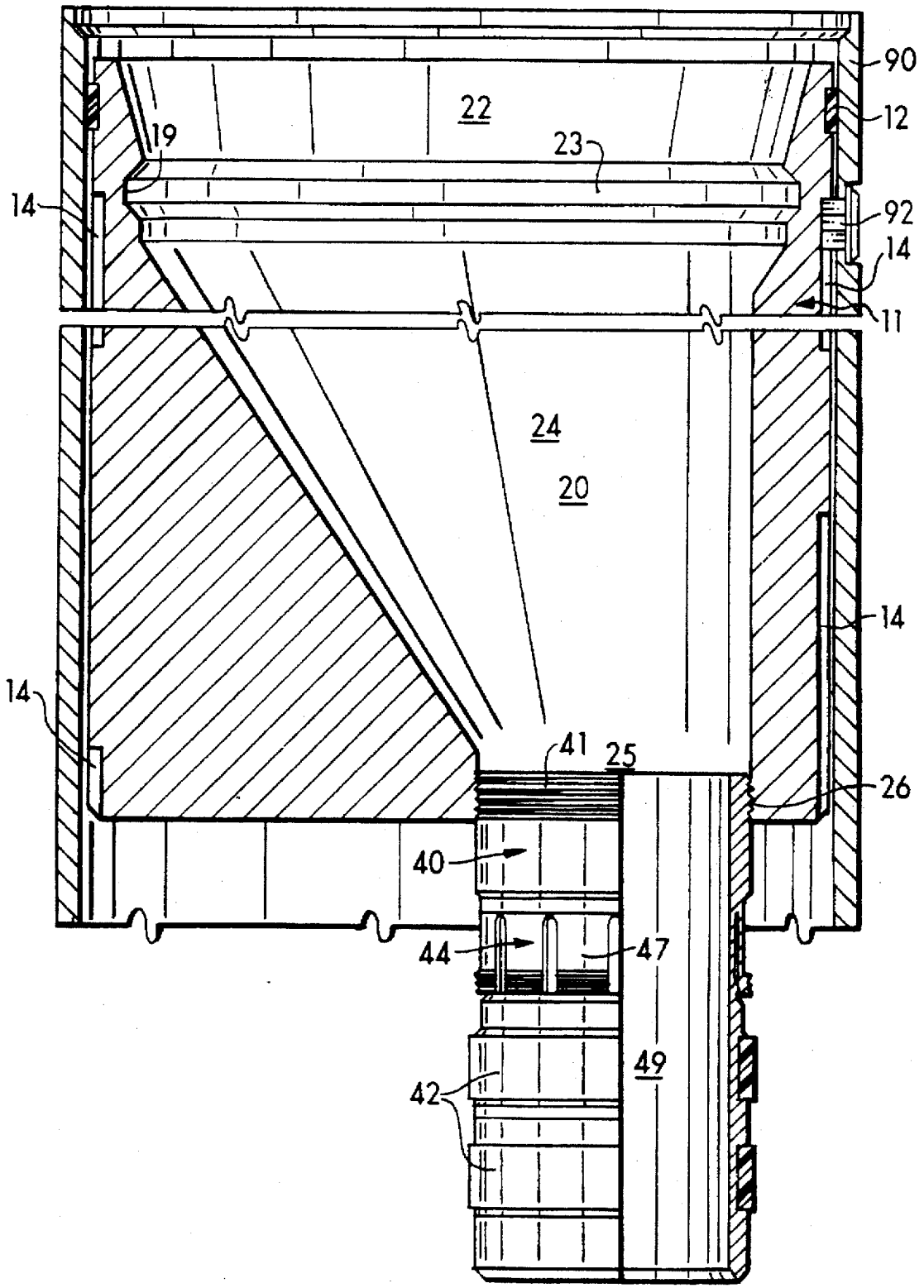
FIG. 2 is a partially cutaway, perspective view of the assembly illustrated in FIG. 1.

Cam 11 is provided with a bore 20 therethrough (FIG. 2). Bore 20 has a first uniformly tapered portion 22, a second generally concentric annular portion 23, a third non-uniformly tapered portion 24, and terminates in an axially offset portion 25. A generally annular profile 19 is provided in cam 11 adjacent the second annular portion 23 of bore 20. The lower portion of cam 11 is provided with screw threads 26. Tubular seal assembly 40 is provided with a bore 49 therethrough, at least one annular seal 42, for example moly glass seal ring(s) such as manufactured by Baker Oil Tools, and a collet 44 having a plurality of fingers 47. Each finger is biased outwardly and a corresponding portion of the external surface of each finger is threaded. Above collet 44, the external surface of tubular 40 is provided with threads 41. As cam 11 and tubular assembly 40 are assembled prior to being mated with a multi well template and positioned at a subsurface location within a well bore, threaded section 41 of tubular seal assembly 40 is engaged with the internal threads 26 of cam 11.

Figure 4:
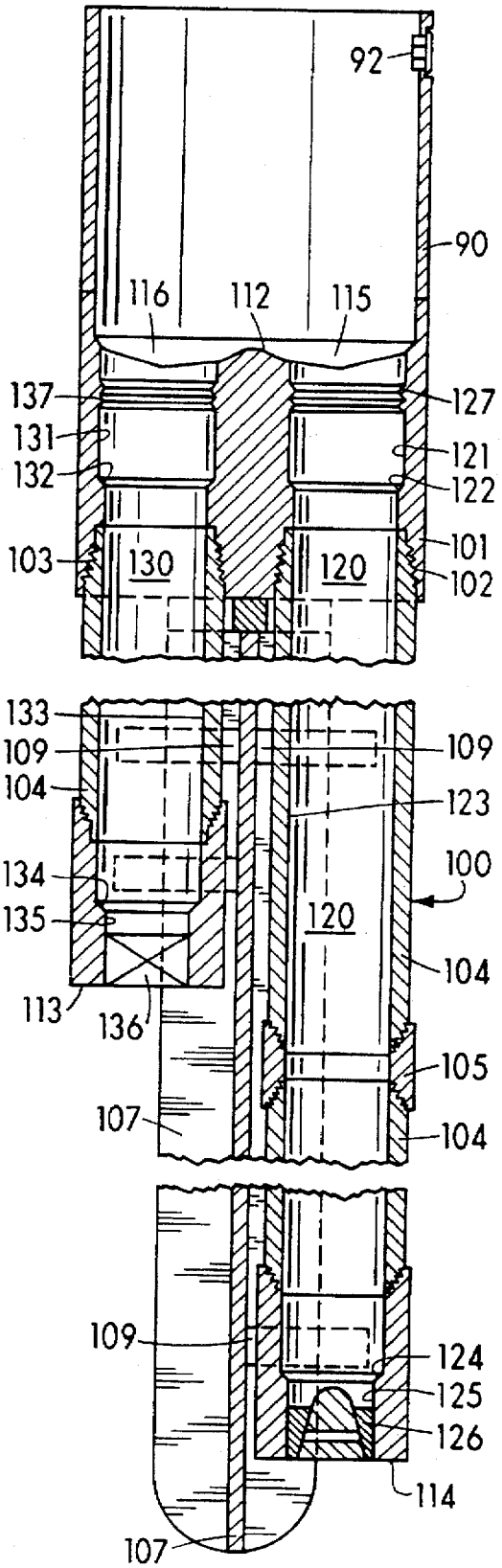
FIG. 4 is a cross sectional view of a downhole or subsurface template.

An example of a suitable downhole or subsurface template is illustrated in FIG. 4 generally as 100 and is comprised of a first upper section 101, an elongated frame 107, and a plurality of tubular members 104. First upper section 101 is provided with two bores therethrough having lower threaded sections 102. The end face 112 of first section 101 is formed with indentations 115, 116 surrounding the intersection of the two bores. An elongated frame, for example I-beam or H-beam 107, is secured to the other end face of first section 101 by any suitable moans, such as bolts. Generally C-shaped guides 109 are secured to I-beam or H-beam 107 along the length thereof such as by welds. Tubular members 104 are positioned through guides 109 on each side of I-beam or H-beam 107 and mated with threaded sections 102 of the bores through first section 101. Guides 109 function in combination with elongated frame 107 to restrain and inhibit movement of tubular member(s) 104 positioned through such guides. Different tubular members 104 positioned on the same side of I-beam or H-beam 107 are secured together by any suitable means, for example, threaded collar 105. The free end of each tubular member 104 is mated with a shoe 106 into which a float valve 126 is secured on one side of I-beam or H-beam 107 while a plug 136 is inserted into the other side of beam 107.

As illustrated in FIG. 4 bores 120, 130 are each provided with first sections 121, 131, second sections 123, 133, and third sections 125, 135, respectively. The first and second sections of bores 120, 130 define annular shoulders 122, 132 therebetween while the second and third sections of bores 120, 130 define annular shoulders 124, 134 therebetween. Bores 120, 130 may be arranged so as to diverge from each other from end face 112 toward end faces 114, 113, respectively. If arranged to diverge, the degree of such divergence usually should not exceed 2° over the entire length of template 100, and is preferably less than 1°. In the embodiment illustrated in FIG. 4, bore 130 is shorter than bore 120 to provide a portion of subterranean formation between end faces 113 and 114 within which the drill string emanating from bore 130 may be deviated so as to minimize the possibility of interference between well bores which are drilled and completed in accordance with the present invention. Bores 120 and 130 may also be substantially identical in length. In either embodiment, one or both sides of I-beam 107 may be provided with a whipstock(s) secured thereto below bore(s) 120 and/or 130 by any suitable means, such as welds, to further assist in minimizing interference between the well bores drilled utilizing template 100 in accordance with the present invention.

As thus assembled, first section 101, beam 107 and tubular members 104 define a template 100 having two generally cylindrical bores 120, 130 therethrough. Exemplary of the relative dimensions of template 100, the length of first section may be 1.22 meters, beam 107 may be 9.14 meters, and intermediate or surface casing 90 may be 2.44 meters. Where each bore does not extend beyond frame 107, the length of bore 130 as measured from the bottom of first section 101 to end face 113 may be up to 9.14 meters or less, while the length of bore 120 as measured from the bottom of first section 101 to end face 114 may be up to 13.72 meters or less. Where bore 130 extends beyond frame 107, the length of bore 130, as measured from the bottom of first section 101 to end face 113, may be up to a thousand meters or more, Bore 120 is longer than bore 130 and may be extended, as measured from the bottom of first section 101 to end face 314, up to 3,048 meters or more depending upon the formations to be drilled and completed in accordance with the present invention.

Figure 5:
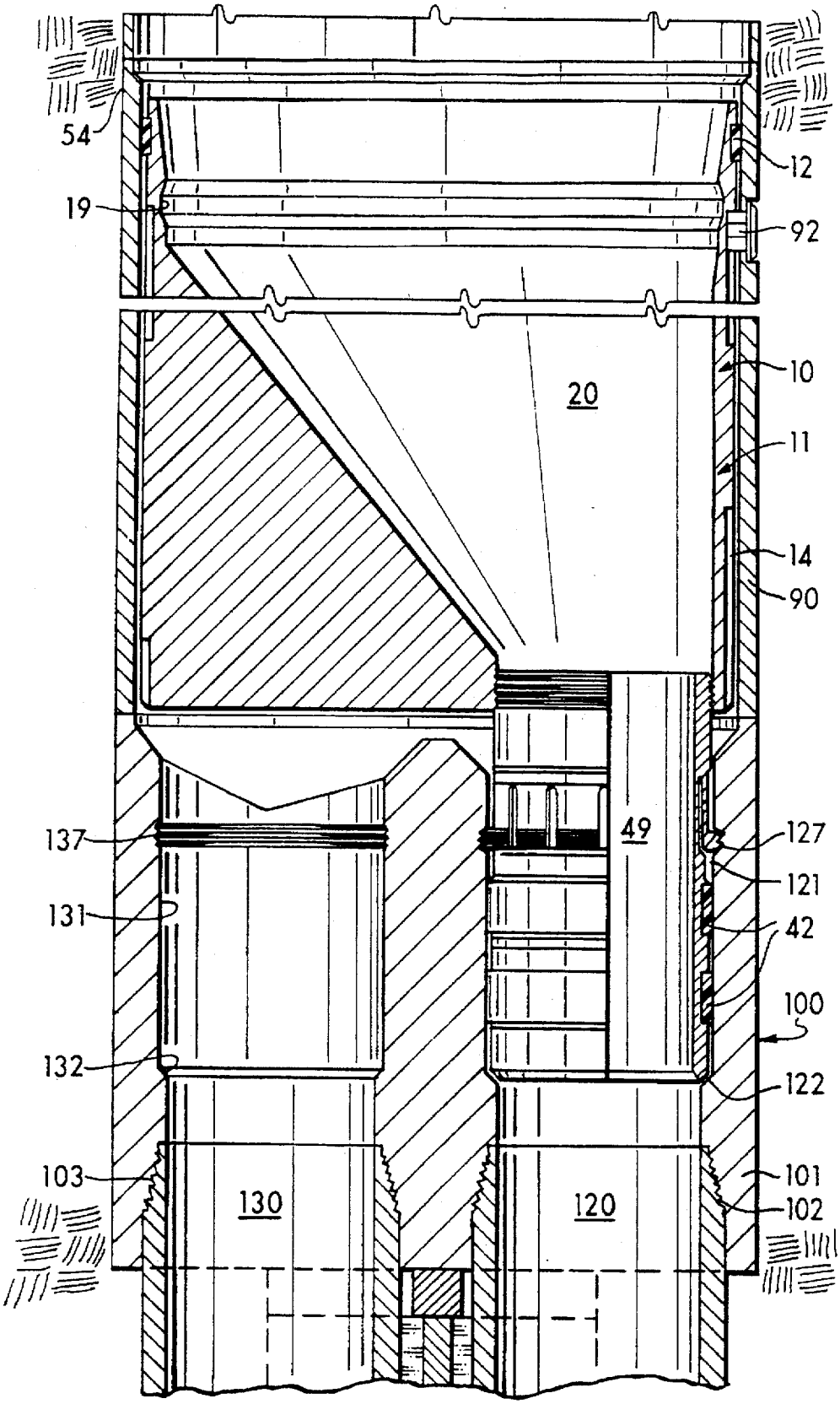
FIG. 5 is a partially cutaway, perspective view of the assembly of FIGS. 1 and 2 depicting the seal assembly thereof sealingly positioned within a bore of a multiple well subsurface template.

As illustrated in FIGS. 4 and 5, template 100 is preferably secured to a section of conductor, surface, or intermediate casing 90 by any suitable means, such as by threads or welds. Casing 90 is provided with an inwardly extending dog or key 92. The external surface of cam 11 is provided with a J-4 slot 14 which in conjunction with key 92 functions to orient tubular 40 for insertion into either bore 120 or 130 in a manner hereinafter described.

Figure 3:
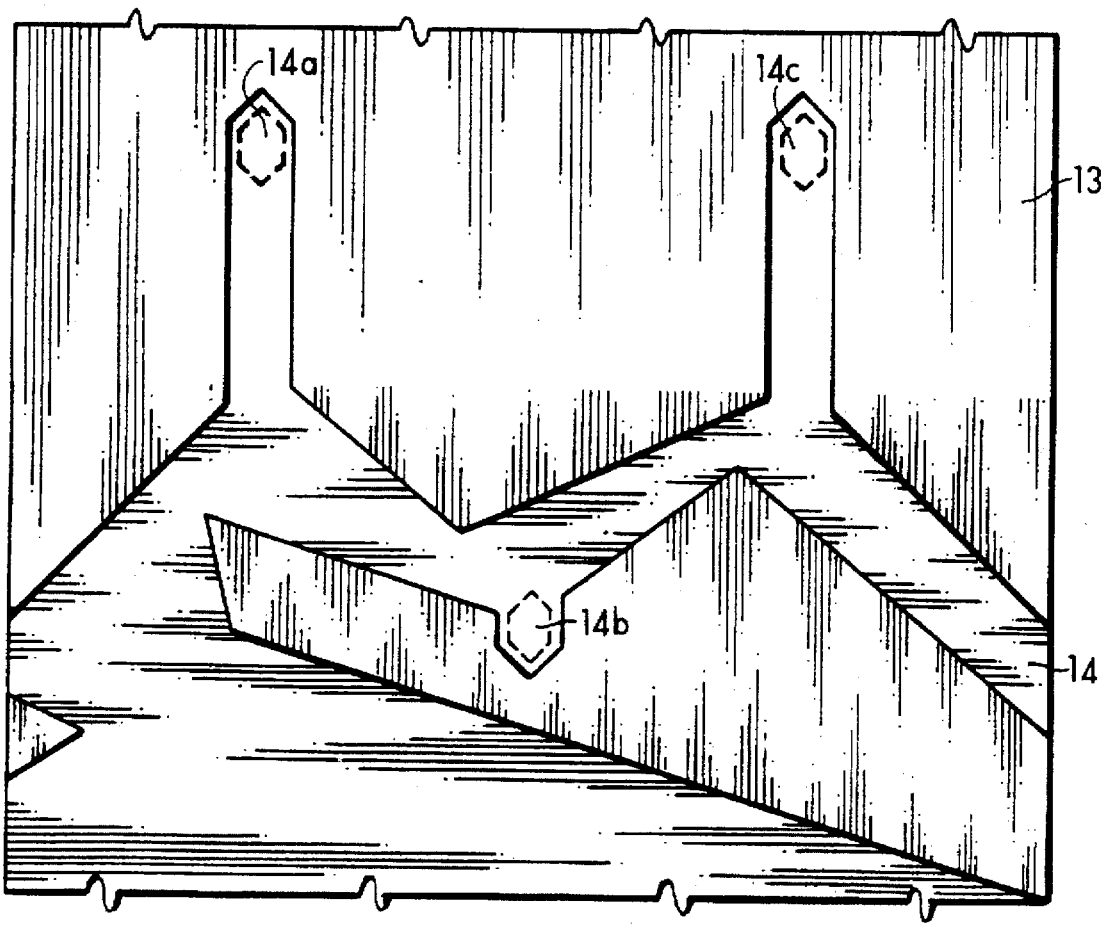
FIG. 3 is a partially cutaway, 360° expanded view of the external surface of the positioning cam of the present invention.

In operation, template 100 is secured to the bottom section or joint of surface or intermediate casing 90 at the surface by any suitable means, such as screw threads. Assembly 10 is lowered within this bottom section or joint of surface or intermediate casing 90 until key 92 contacts slot 14 in the external surface of cam 11. The inclined surfaces of slot 14 cause cam 11 and the tubular seal assembly to rotate until key 92 assumes position 14*a* as illustrated in FIG. 3. As thus oriented, tubular seal assembly 40 will be aligned with and positioned within bore 120 of template 100 such that collet fingers 47 engage threaded section 127 of bore 120 and seal(s) 42 of seal assembly 40 engage the internal walls of first section 121 of bore 120 so as to provide a fluid tight seal therebetween. As illustrated in FIGS. 2 and 5, annular seal(s) 12 of assembly 10 engage the internal surface of the bottom section or joint of surface or intermediate casing 90 so as to provide a fluid tight seal therebetween. Preferably, the internal surface of the bottom section or joint of surface or intermediate casing 90 is polished so as to ensure the integrity of the seal formed upon engagement by annular seal(s) 12 of assembly 10.

As thus assembled, surface or intermediate casing 90 is positioned within well bore 54 by securing additional sections or joints of casing together in a conventional manner as the casing string is lowered into the well bore as will be evident to a skilled artisan. Casing 90 is then cemented within well bore 54 by conventional techniques. A conventional drill string including a drill bit and mud motor (not illustrated) is lowered within casing 90 and is funneled through bore 20 by means of first and third tapered portions 22 and 24 and through bore 49 in seal assembly 40 and into bore 120 of template 100 whereupon valve 126 and cement, if any, is drilled out of bore 120. Thereafter, a first well bore is drilled by the drill string in a conventional manner as will be evident to the skilled artisan with drilling mud surface through the drill string and drilling mud and formation cuttings being circulated out of the well bore and through bores 20 and 49 in the assembly and the annulus defined between the drill string and casing 90 to the surface. Seals 12 and 42 function to isolate bore 130 of the template and a significant portion of the external surface of cam 11 and seal assembly 40 from circulated drilling mud. This first well bore can be drilled in a vertical or deviated orientation. Thereafter, the drill string is pulled to the surface and casing which is equipped with a liner hanger can be lowered into the first well bore through bores 20 and 49 in the assembly by means of drill pipe and secured to template 10 and cemented within the first well bore by conventional techniques.

The drill string is equipped with a suitable pulling tool near the lower end thereof. The drill string is lowered within casing 90 and funneled through bore 20 by means of first and third tapered portions 22 and 24 until the pulling tool is engaged within annular profile 19 in bore 20 of the assembly 10. The drilling string is then raised thereby causing collet fingers 147 to disengage from threaded section 127 of bore 120 so as to permit the assembly 10 to be raised until engagement of key 92 within slot 14 causes the orienting cam 11 to automatically rotate until key 92 to assumes position 14*b* within slot 14 (FIG. 3). Subsequent lowering of the drill string causes the cam to rotate until key 92 is positioned at 14*c* within slot 14. In this orientation, tubular seal assembly 14 will be aligned with and positioned within bore 130 of template 100 such that collet fingers 47 engage threaded section 137 of bore 130 and seal(s) 42 of seal assembly 40 engage the internal walls of first section 131 of bore 130 so as to provide a fluid tight seal therebetween. As illustrated in FIGS. 2 and 5, annular seal(s) 12 of cam 11 engage the internal surface of the bottom section or joint of surface or intermediate casing 90 so as to provide a fluid tight seal therebetween. Thereafter, the drill string is utilized to drill plug 136 out of bore 130 of template 100. The drill string is passed through bore 30 and a second well bore is drilled in a conventional manner with drilling mud being circulated from the surface through the drill string and drilling mud and formation cuttings being circulated out of the second well bore and through bores 20 and 49 in the assembly and the annulus defined between the drill string and casing 90 to the surface. Seals 12 and 42 function to isolate bore 120 of the template and a significant portion of the external surface of cam 11 and seal assembly 40 from circulated drilling mud. The second well bore can also be drilled in a vertical or deviated orientation. Thereafter, the drill string is pulled to the surface. Casing which is equipped with a suitable liner hanger is then lowered into the second well bore through bores 20 and 49 in assembly 10 by means of drill pipe and is secured to template 100, and thus surface or intermediate casing 90, by conventional means. The casing can be cemented within the second well bore. The drill string is equipped with a suitable pulling tool and lowered within casing 90 until the pulling tool becomes engaged within annular notch 19 in bore 20. Subsequent lifting of the drill string causes collet fingers 147 to disengage from threaded section 137 of bore 130. Engagement of key 92 in slot 14 causes key 92 to disengage from slot 14 thereby permitting the drill string and assembly 10 to be raised to the surface. Assembly 10 can be utilized in conjunction with a downhole or subsurface multiple well drilling template to drill and complete wells from onshore drilling rigs, subsea well heads or offshore platforms.

Figure 6:
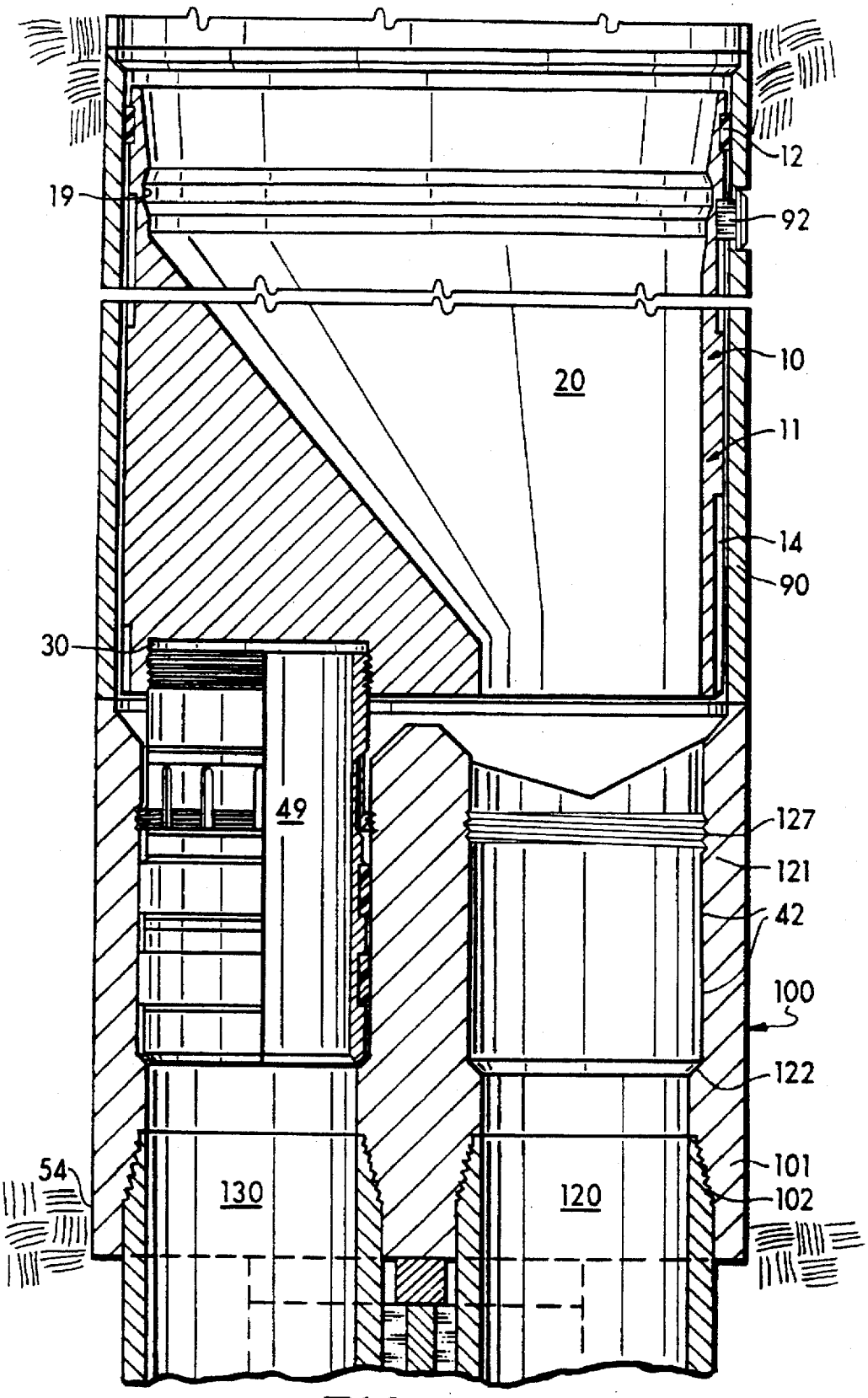
FIG. 6 is a partially cutaway, perspective view of another embodiment of the assembly of the present invention depicting the seal assembly thereof sealingly positioned within a bore of a multiple well subsurface template.

In accordance with another embodiment of the present invention as illustrated in FIG. 6, cam 11 is provided with a threaded bore 30 in one face thereof adjacent axially offset portion 25 of bore 20. Cam 11 and tubular assembly 40 am assembled by engaging threaded section 41 of tubular seal assembly 40 within threaded bore 30 of cam 11. As thus constructed, when tubular seal assembly 40 is aligned with and positioned within bore 130 of template 100 in a manner as described above with reference to FIGS. 1–5, bore 20 of cam 11 will function to funnel a conventional drill string into bore 120 of template 100 during drilling operations as described above.

Figure 7:
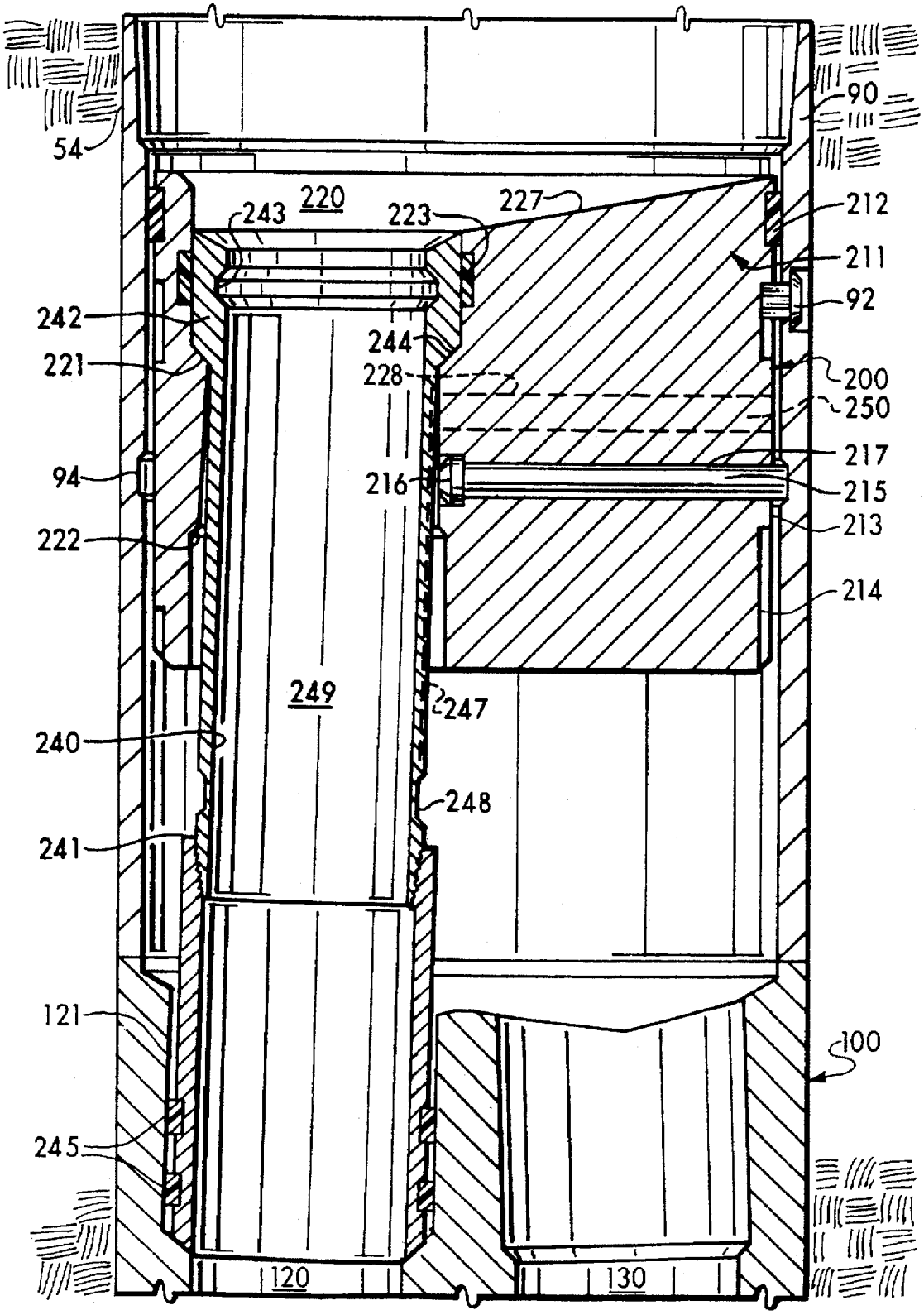
FIG. 7 is a cross sectional view of yet another embodiment of the assembly of the present invention which depicts the seal assembly thereof as sealingly positioned within a bore of a multiple well subsurface template.
Figure 8:
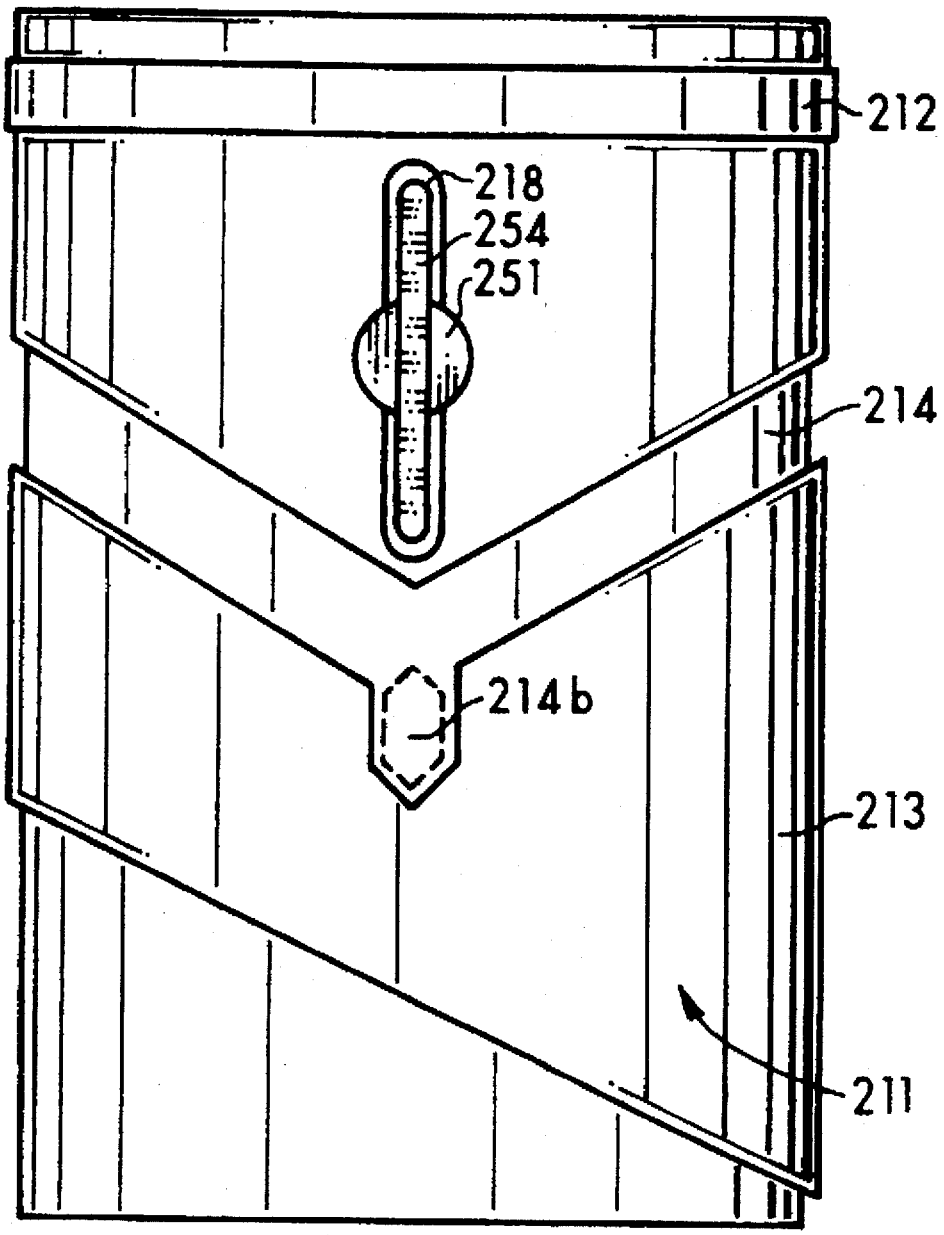
FIG. 8 is a perspective view of the positioning cam of the present invention which is utilized in conjunction with a tubular seal assembly and a multiple well subsurface template.

Another embodiment of the assembly of the present invention is illustrated in FIG. 7. The apparatus of the present invention is illustrated generally as 200 and comprises a positioning cam 211 and a tubular seal assembly 240 which is secured to and depends from cam 211 in a manner described below. Cam 211 is provided with at least one annular seal 212, for example moly glass seal ring(s) such as manufactured by Baker Oil Tools, around the outer periphery thereof and a J-4 slot 214 formed in the external surface 213 thereof (FIG. 8). Cam 211 is also provided with a bore 220 therethrough of varying diameter so as to define first and second annular shoulders 221 and 222. At least one annular seal 223, for example moly glass seal ring(s) such as manufactured by Baker Oil Tools, is provided about the outer periphery of bore 220 near one end thereof. A pin 215 having an enlarged head portion 216 is positioned within a bore 217 which extends through cam 211 from bore 220 to external surface 213.

Figure 9:
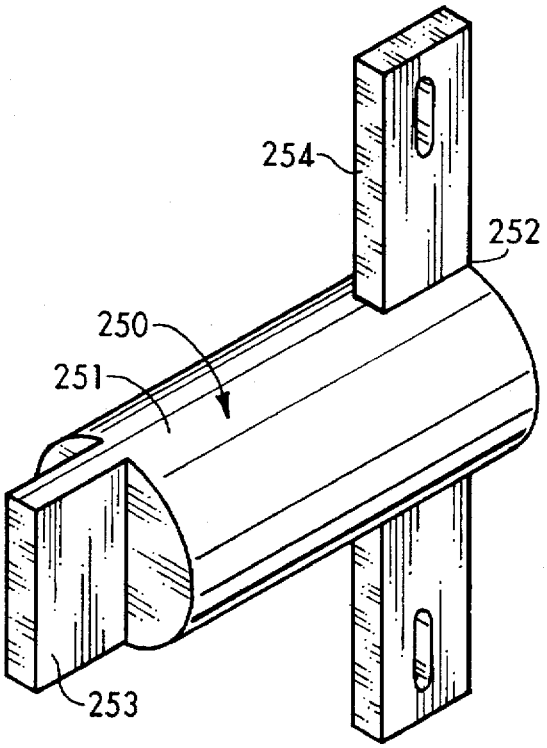
FIG. 9 is a perspective view of certain component parts of the positioning cam of the present invention.

A tubular seal assembly 240 is provided with a bore 249 therethrough and is comprised of sections which are secured together by any suitable means, such as screw threads, thereby defining a generally annular, external shoulder 241. One end portion 242 of tubular seal assembly 240 is enlarged so as to define an annular shoulder 244 about the external diameter of assembly 240. A beveled profile 243 is provided within the internal surface of enlarged end portion 242, while a slot 247 (FIG. 10) is provided in the external surface of tubular seal assembly 240 intermediate the length thereof. A slot 218 (FIG. 8) is formed in the external surface 213 of cam 211 and preferably has a generally longitudinal orientation. A locking mechanism illustrated generally as 250 in FIG. 9 comprises a generally cylindrical body 251 having a slot or groove 252 formed in one end face thereof and a tongue or protuberance 253 projecting from the other end face thereof. An elongated bar 254 is positioned within slot 252 intermediate the length of bar 254. As assembled, bar 254 is positioned within slot 218 in cam 211 and body 251 is positioned within a bore 228 which extends through cam 211 from bore 220 to external surface 213. Preferably, bore 228 is not radially aligned with bore 217 as illustrated in FIG. 7. Tongue 253 extends into slot 247 in the external surface of the tubular seal assembly 240. When assembly 200 is lowered into casing 90 which has been previously cemented within a well bore 54, tongue 253 is initially positioned at **247*a* in slot 247. In this position, bar 254 is bent within slot 218**.

Figure 10:
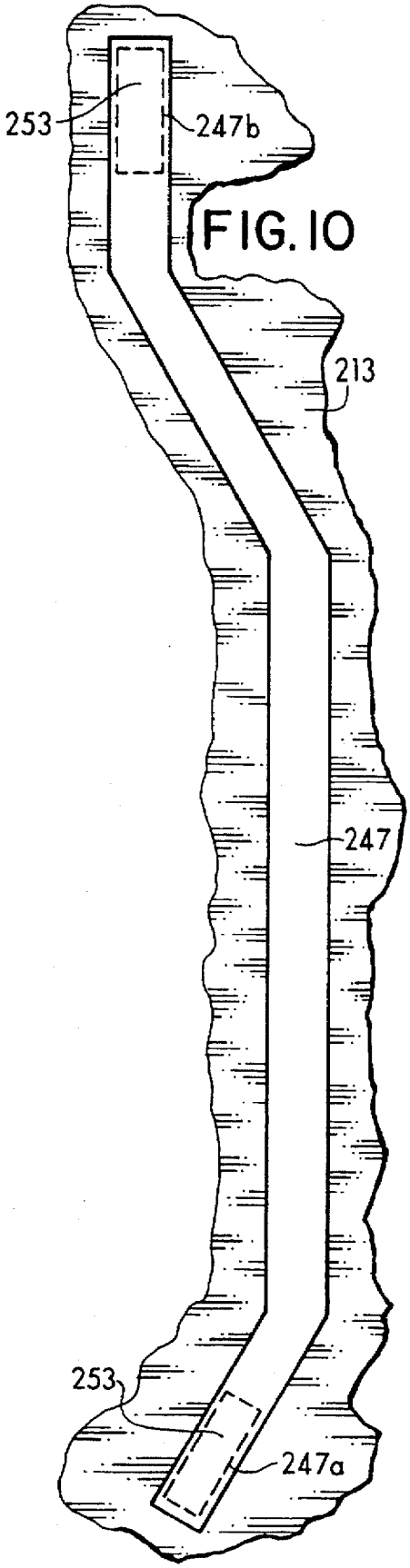
FIG. 10 is a schematic illustration of the configuration of the groove which is formed in the external surface of the seal assembly of the present invention.
Figure 11:
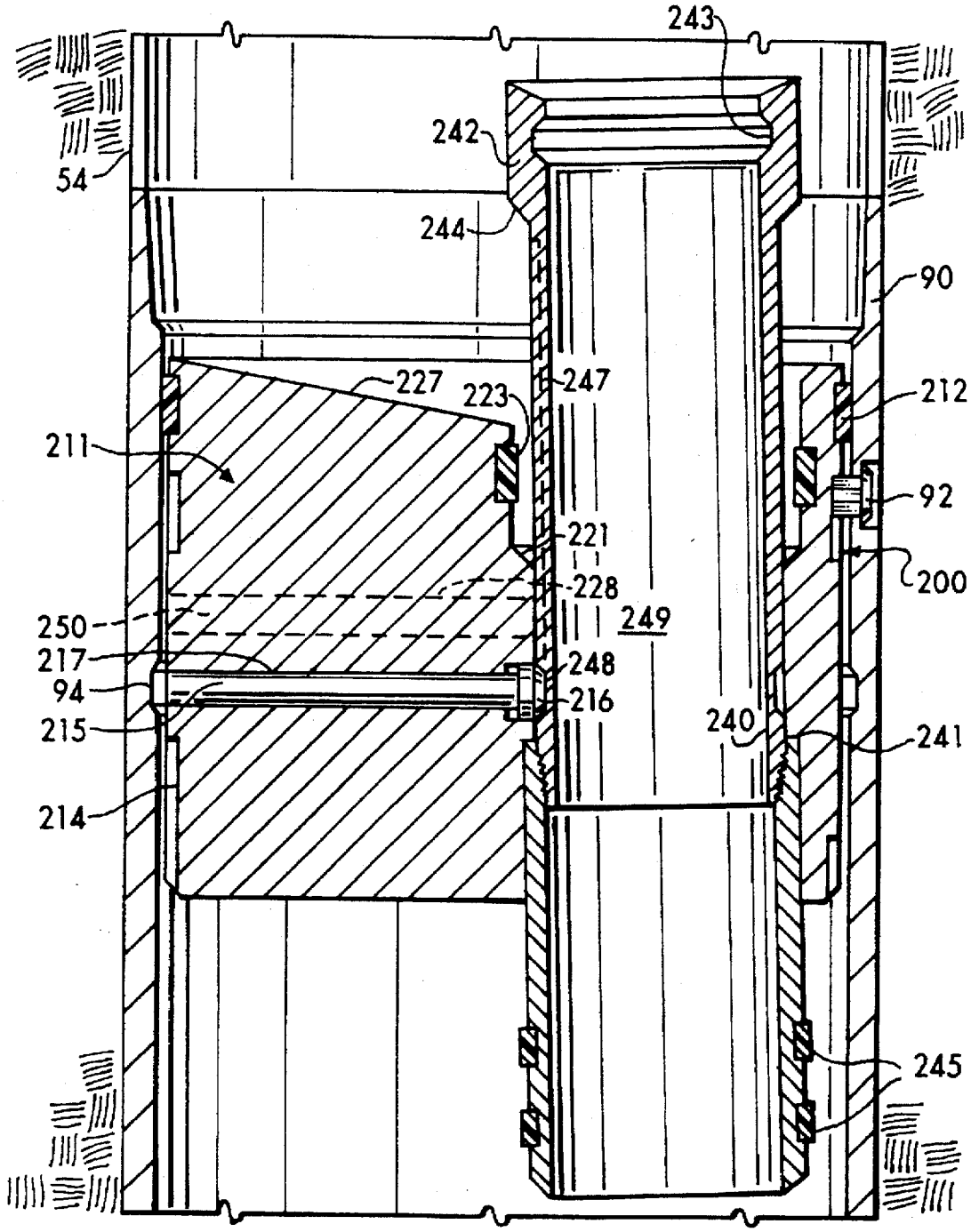
FIG. 11 is a cross sectional view of the embodiment of the assembly of the present invention illustrated in FIG. 7 which depicts the seal assembly thereof as withdrawn from engagement from a bore of a multiple well subsurface template and aligned with another bore of the multiple well subsurface template.
Figure 12:
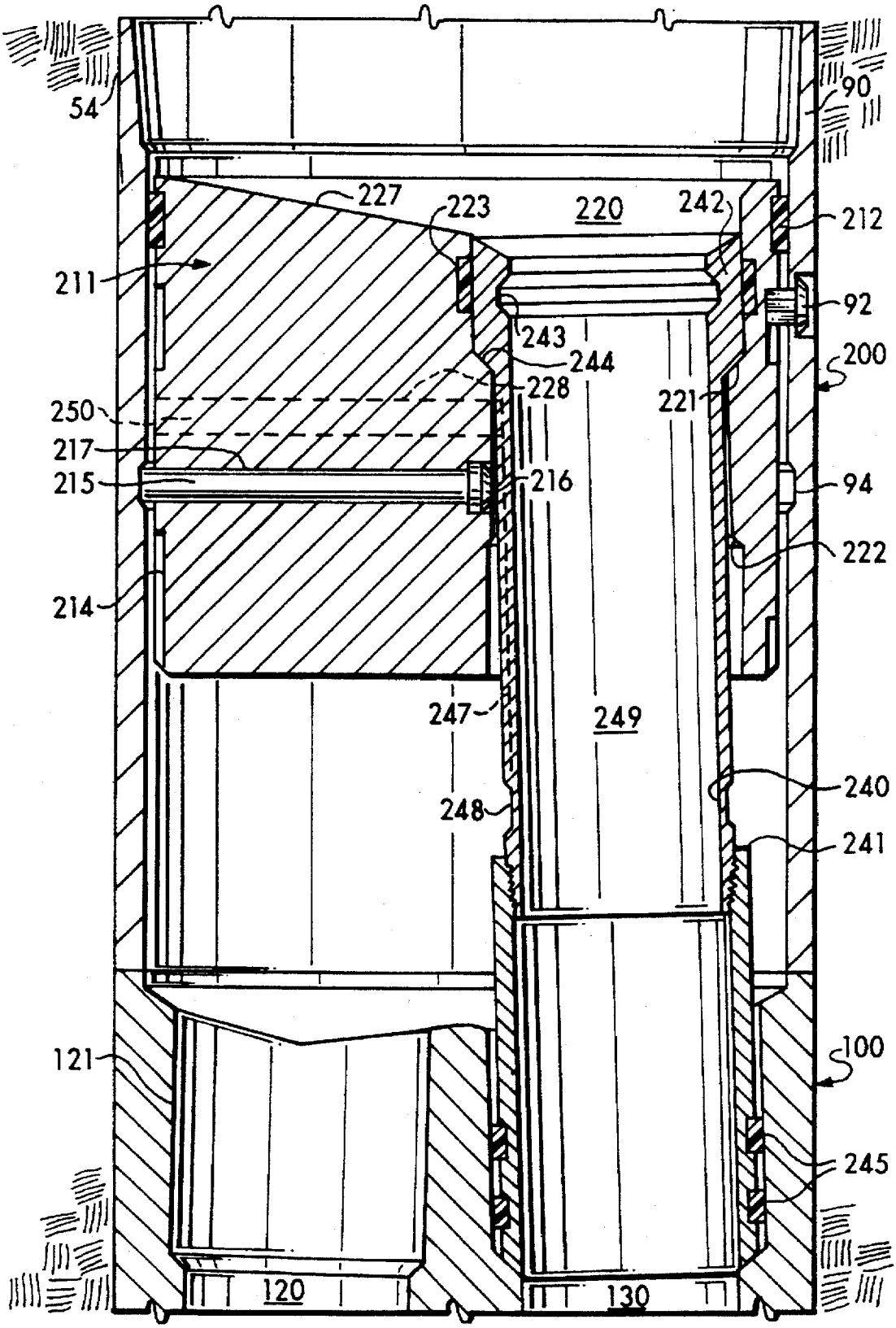
FIG. 12 is a cross sectional view of the assembly of the present invention illustrated in FIG. 7 which depicts the seal assembly thereof as sealingly positioned within another bore of a multiple well subsurface template.

In operation, template 100 is secured to the bottom section or joint of surface or intermediate casing 90 at the surface by any suitable means, such as screw threads and the surface or intermediate casing 90 is positioned within well bore 54 by securing additional sections or joints of casing together in a conventional manner as the casing string is lowered into the well bore as will be evident to a skilled artisan. Assembly 200 is then lowered within this bottom section or joint of surface or intermediate casing 90 by means of a suitable tool secured to drill pipe and engaged within beveled profile 243 in the internal surface of enlarged end portion 242. Assembly 200 is lowered until key 92 contacts slot 214 in the external surface of cam 211. The inclined surfaces of slot 214 cause cam 211 and the tubular seal assembly to rotate until key 92 assumes position **14*a* as illustrated in FIG. 3. As thus oriented, tubular seal assembly 240 will be aligned with bore 120 of template 100. As illustrated in FIG. 10, tongue 253 is initially positioned at 247*a* within slot 247 in tubular assembly 240 and secures tubular assembly 240 in a retracted position as illustrated in FIG. 11. In this position, the enlarged head portion 216 of pin 215 is received within recess 248 in the external surface of assembly 240 and shoulder 241 on the exterior of tubular assembly 240 contacts shoulder 222 within bore 220 so as to retain assembly 240 within bore 220. Movement of tongue 253 within slot 247 is inhibited by the configuration of slot 247. Application of sufficient force, e.g. 25,000 psi, to bar 254 via drill pipe (not illustrated), assembly 240, slot 247 and tongue 253 is necessary to overcome the force exerted upon tongue 253 in slot 247 by bar 254 being bent within slot 218 and permit bar 254 to move into the elongated portion of slot 247. Alternatively, slot 247*a* may be aligned with the elongated portion of the slot and head 216 of pin 215 may be spring loaded to retain tongue 253 at the lower end of slot 247 until sufficient force, e.g. 25,000 psi, is applied to retract head 216. Assembly 240 is then lowered through bore 220 and into bore 120 of template 100. Seal(s) 245 of seal assembly 240 engage the internal walls of first section 121 of bore 120 so as to provide a fluid tight seal therebetween. Shoulder 242 of seal assembly 240 abuts shoulder 221 of bore 220 and seal(s) 223 provide for a fluid tight seal. In this lowered position, tubular seal assembly 240 forces pin 215 into recess 94 in the wall of casing 90 to further secure cam 211 to casing 90. Also, sufficient force, e.g. 50,000 psi, must be applied to bar 254 via drill pipe, assembly 240, slot 247 and tongue 253 to bond bar 254 within slot 218 and permit tongue 253 to be positioned at 247*b* within slot 247. The force necessary to move tongue 253 to position 247*b* also unlatches the tool which is secured to drill pipe from engagement with profile 243. As illustrated in FIG. 7, annular seal(s) 212 of assembly 200 engage the internal surface of the bottom section or joint of surface or intermediate casing 90 so as to provide a fluid tight seal therebetween. Preferably, the internal surface of the bottom section or joint of surface or intermediate casing 90 is polished so as to ensure the integrity of the seal formed upon engagement by annular seal(s) 212 of assembly 200. It will be evident to a skilled artisan that slot 214 as utilized in this embodiment of the assembly of the present invention will be configured similarly to slot 14 is illustrated in FIG. 3 except that the vertical portions of slot 214 which correspond to positions 214*a* and 214*c* will be shortened since tubular seal assembly 240 is slidably secured to positioning cam 211** and thus can be lowered into engagement with a bore of a multiple well template once the cam has been aligned in a manner as just described.

The drill string with suitable tool secured thereto is lifted to the surface and casing 90 is then cemented within well bore 54 by conventional techniques. A conventional drill string including a drill bit and mud motor (not illustrated) is lowered within casing 90 and is funneled through bore 220 by means of tapered portion 227 of bore 220 and through bore 249 in seal assembly 240 and into bore 120 of template 100 whereupon valve 126 and cement, if any, is drilled out of bore 120. Thereafter, a first well bore is drilled and completed in a manner as described above with respect to FIGS. 1–5.

When appropriate, it is preferred to position assembly 200 within the bottom section of surface or intermediate casing 90 at the surface such that seal(s) 245 of seal assembly 240 engage the internal walls of first section 121 of bore 120 in the manner as described above. In this embodiment, cam 211 and seal assembly 240 am fully assembled to template 100 at the surface and the surface or intermediate casing 90 with template 100 secured thereto is positioned within well bore 54 by securing additional sections or joints of casing together in a conventional manner as the casing string is lowered into the well bore. In this manner, the need to utilize drill pipe having a suitable tool secured thereto to positioned assembly 200 downhole within template 100 is eliminated.

After the first well is drilled, the drill string which is equipped with a suitable pulling tool attached near the lower end thereof is lowered within casing 90 and funneled through bore 230 by means of tapered portion 227 and through bore 249 of seal assembly 240 until the pulling tool is engaged within annular profile 243 in seal assembly 240. The drill string is then raised until sufficient pressure is exerted upon rod 254 to bend same thereby permitting tongue 253 to rotate and move within slot 247. Assembly 200 is raised until shoulder 241 abuts shoulder 222 thereby causing head 216 of pin 215 to be retracted into annular recess 248 which is formed in the external surface of tubular seal assembly 240 and thereby permitting cam 211 to also be raised. Engagement of key 92 within slot 214 causes the orienting cam 211 to automatically rotate until key 92 to assumes position 214b (FIG. 3) within slot 214. Subsequent lowering of the drill string causes the cam to rotate until key 92 is positioned at 214c within slot 214. In this orientation, tubular seal assembly 240 will be aligned with bore 130 of template 100 such that seal(s) 242 of seal assembly 240 will engage the internal walls of first section 131 of bore 130 upon being lowered so as to provide a fluid tight seal therebetween. Once seal assembly is completely lowered, pin 215 will be forced into engagement with annular recess 94 in the internal surface of casing 90. Thereafter, the drill string is utilized to drill plug 136 out of bore 130 of template 100. The drill string is passed through bore 130 and a second well bore is drilled and completed in a manner as described above with respect to FIGS. 1–5.

The drill string is then raised to the surface which causes the pulling tool to be engaged within profile 243 in tubular seal assembly. Engagement of key 92 with slot 214 causes key 92 to disengage from slot 214 thereby permitting the drill string and assembly 200 to be raised to the surface. Assembly 200 can be utilized in conjunction with a downhole or subsurface multiple well drilling template to drill and complete wells from onshore drilling figs, subsea well heads or offshore platforms. Although the assembly of the present invention has been illustrated and described as being utilized in conjunction with a subsurface or downhole template having two bores therethrough, it will be evident to a skilled artisan that the assembly can be utilized with a subsurface or downhole template having three or more bores. When three bores are provided through the template, slot 14 or 214 on the outer surface of cam 11 or 211 will be reconfigured in a manner as will be evident to a skilled artisan to permit rotation of cam 11 or 211 in 120° increments. When more than three bores are provided through the template, slot 14 or 214 on the outer surface of cam 11 or 211 will be reconfigured to permit rotation of cam 11 or 211 in degreed increments as will be evident to a skilled artisan.

While the foregoing preferred embodiments of the invention have been described and shown, it is understood that the alternatives and modifications, such as those suggested and others, may be made thereto and fall within the scope of the invention.

I claim:

1. A process for drilling subterranean wells from a casing which extends from a subterranean depth to the surface of the earth and to which a downhole or subsurface template having at least two bores therethrough is secured, said process comprising:

drilling a first subterranean well bore through one of said bores and into a subterranean formation; and circulating fluid to the surface during said drilling step via said casing.

2. The process of claim 1 further comprising:

drilling a second subterranean well bore through another of said bores into a subterranean formation; and circulating fluid to the surface during said drilling step via said casing.

3. The process of claim 1 wherein said first casing is surface casing.

4. The process of claim 1 wherein said first casing is intermediate casing.

5. The process of claim 1 wherein said first casing is generally vertical.

6. The process of claim 1 wherein said first casing is deviated.

7. The process of claim 1 wherein said fluid is drilling mud and cuttings from said subterranean formation.

8. The process of claim 1 wherein said first subterranean well bore is drilled by means of a drill string having a drill bit secured thereto which is positioned through said casing and said one of said bores, said fluid being circulated to the surface during drilling of said first well bore via an annulus defined between said drill string and said casing.

9. A process for drilling subterranean wells from a casing which extends from a subterranean depth to the surface of the earth and to which a downhole or subsurface template having at least two bores therethrough is secured, said process comprising:

positioning an orienting cam having a bore therethrough above said template such that said bore through said orienting cam is aligned with one of the at least two bores through the template;

providing a fluid tight seal between said orienting cam and said casing; and providing a fluid tight seal between said orienting cam and said one of the at least two bores through the template.

10. The process of claim 9 further comprising:

circulating fluid to the surface via said bore in said orienting cam and via said casing during drilling a first subterranean well bore through said one of said bores and into a subterranean formation.

11. The process of claim 9 further comprising:

repositioning said orienting cam above said template such that said bore through said orienting cam is aligned with another of the at least two bores through the template; and providing a fluid tight seal between said orienting cam and said another of the at least two bores through the template.

12. The process of claim 11 further comprising:

circulating fluid to the surface via said casing during drilling a second subterranean well bore through said another of said bores and into a subterranean formation.

13. The process of claim 9 wherein said step of providing a fluid tight seal between said orienting cam and said one of the at least two bores through the template comprises inserting a portion of a tubular assembly which is sealingly secured to and slidingly depends from said cam into said one bore, said portion of said tubular assembly which is inserted into said one bore of said template having substantially annular seals about the exterior thereof.

14. The process of claim 13 wherein further comprising:

releasably locking said tubular assembly in the position where said portion of said tubular assembly is inserted into said one bore of said template.

15. The process of claim 9 wherein the step of positioning said orienting cam above said template such that said bore through said orienting cam is aligned with one of the at least two bores through the template comprises contacting said cam with a key which is secured to said casing, said key and said cam cooperating upon contact to align said riser with said one of the at least two bores through the template.

16. The process of claim 11 wherein the step of repositioning said orienting cam above said template such that said bore through said orienting cam is aligned with another of the at least two bores through the template comprises contacting said cam with a key which is secured to said casing, said key and said cam cooperating during contact to align said riser with said one of the at least two bores through the template.

17. The process of claim 10 wherein said first subterranean well bore is drilled by passing a drill string including a drill bit from the surface through said casing, said bore through said orienting cam and said one bore through said template.

18. The process of claim 17 wherein said fluid is circulated from the surface through said drill string and back to the surface via said first subterranean well bore, said one of the at least two bores through the template, said bore through said orienting cam and an annulus defined between said drill string and said casing.

19. The process of claim 12 wherein said second subterranean well bore is drilled by passing a drill string including a drill bit from the surface through said casing, said bore through said orienting cam and said another bore through said template.

20. The process of claim 19 wherein said fluid is circulated from the surface through said drill string and back to the surface via said second subterranean well bore, said another of the at least two bores through the template, said bore through said orienting cam and an annulus defined between said drill string and said casing.

* * * * *

UNITED STATES PATENT AND TRADEMARK OFFICE

CERTIFICATE OF CORRECTION

PATENT NO. : 5,685,373

DATED : November 11, 1997

INVENTOR(S) : Gary J. Collins, Kevin O. Trahan, and John Lindley Baugh

It is certified that error appears in the above-indentified patent and that said Letters Patent is hereby corrected as shown below:

Col. 5, line 43: After "mud", insert--being circulated from the--.

Signed and Sealed this

Fourteenth Day of July, 1998

Bruce Lehman

*Attest:*

BRUCE LEHMAN

*Attesting Officer*

*Commissioner of Patents and Trademarks*